US010932488B2

(12) United States Patent
Chen

(10) Patent No.: US 10,932,488 B2
(45) Date of Patent: Mar. 2, 2021

(54) COVER ASSEMBLY, ATOMIZER, AND ELECTRONIC CIGARETTE HAVING SAME

(71) Applicant: SHENZHEN IVPS TECHNOLOGY CO., LTD., Shenzhen (CN)

(72) Inventor: Wen Chen, Shenzhen (CN)

(73) Assignee: SHENZHEN IVPS TECHNOLOGY CO., LTD., Guangdong (CN)

( * ) Notice: Subject to any disclaimer, the term of this patent is extended or adjusted under 35 U.S.C. 154(b) by 315 days.

(21) Appl. No.: 15/972,700

(22) Filed: May 7, 2018

(65) Prior Publication Data

US 2018/0317556 A1 Nov. 8, 2018

(30) Foreign Application Priority Data

May 8, 2017 (CN) ..... 201720507066.9

(51) Int. Cl.
*A24F 40/40* (2020.01)
*A24F 47/00* (2020.01)

(52) U.S. Cl.
CPC ..... *A24F 40/40* (2020.01); *A24F 47/008* (2013.01)

(58) Field of Classification Search
CPC ..... A24F 47/008; A24F 40/40
See application file for complete search history.

(56) References Cited

U.S. PATENT DOCUMENTS

| | | | | |
|---|---|---|---|---|
| 2016/0213061 | A1 | 7/2016 | Liu | |
| 2017/0164655 | A1* | 6/2017 | Chen | A24F 47/008 |
| 2017/0231283 | A1* | 8/2017 | Gadas | A24F 7/02 131/329 |
| 2018/0277805 | A1* | 9/2018 | Chen | A24F 47/008 |
| 2018/0317556 | A1* | 11/2018 | Chen | A24F 40/49 |
| 2019/0297953 | A1* | 10/2019 | Qiu | A61M 11/042 |
| 2019/0307174 | A1* | 10/2019 | Qiu | A24F 9/16 |
| 2020/0107577 | A1* | 4/2020 | Liu | A24F 40/05 |

FOREIGN PATENT DOCUMENTS

| | | | |
|---|---|---|---|
| CN | 203434220 | U | 2/2014 |
| CN | 205214210 | U | 5/2016 |
| CN | 205695707 | U | 11/2016 |
| WO | 2017063535 | A1 | 4/2017 |

* cited by examiner

*Primary Examiner* — James Harvey
(74) *Attorney, Agent, or Firm* — IP-PAL Patent US; Klaus Michael Schmid

(57) ABSTRACT

A cover assembly for an electronic cigarette includes a base, a cover, and a locking assembly. The base defines a filling hole. The cover is mounted to the base and covered on the base to seal the filling hole. The cover is moved with respected to the base to uncover the base when a force is exerted to the cover. The locking assembly locks the cover in the base, and the locking assembly is operated to unlock the cover and allow the cover to move when the force is exerted to the cover.

17 Claims, 7 Drawing Sheets

COVER ASSEMBLY, ATOMIZER, AND ELECTRONIC CIGARETTE HAVING SAME

CROSS REFERENCE TO RELATED APPLICATIONS

The present application claims the benefit of Chinese Patent Application No. 201720507066.9 filed on May 27, 2017, the contents of which are hereby incorporated by reference.

TECHNICAL FIELD

The present disclosure relates to electronic cigarettes, in particular to a battery compartment and an electronic cigarette having the battery compartment.

BACKGROUND

An electronic atomization cigarette functions as substitutes for quitting smoking and cigarette substitutes. The electronic cigarette quickly becomes popular because that the electronic cigarette is easily used, tastes of the electronic cigarette are various, the electronic cigarette is far safer than traditional cigarette and can help the smoker quit smoking. Typically, the electronic cigarette includes an atomizer and a battery assembly. The atomizer is a key component of the electronic cigarette, which is capable of receiving tobacco liquid and heating the tobacco liquid to generate an inhalable aerosol.

However, the cover of the atomizer is commonly unlocked and easily opened by mistake, thus it may cause the tobacco liquid to be leaked when it is unaware of the cover being opened. And it may also cause accident when the cover is opened by the children.

Therefore, there is room for improvement in the art.

SUMMARY

The present disclosure relates to a cover assembly, and an atomizer and an electronic cigarette having the cover assembly. The cover assembly includes a base, a cover, and a locking assembly. The base defines a filling hole. The cover is mounted to the base and covered on the base to seal the filling hole. The cover is moved with respected to the base to uncover the base when a force is exerted to the cover. The locking assembly locks the cover in the base, and the locking assembly is operated to unlock the cover and allow the cover to move when the force is exerted to the cover.

BRIEF DESCRIPTION OF THE DRAWINGS

For a better understanding of the embodiments of the present disclosure or the technical scheme in the prior art, accompanying drawings needed in the description of the embodiments or the prior art are simply illustrated below. Obviously, the accompanying drawings described below are some embodiments of the present disclosure. For the ordinary skill in the field, other accompanying drawings may be obtained according to the structure shown in these accompanying drawings without creative work.

DETAILED DESCRIPTION OF THE PREFERRED EMBODIMENTS

Figure 1:
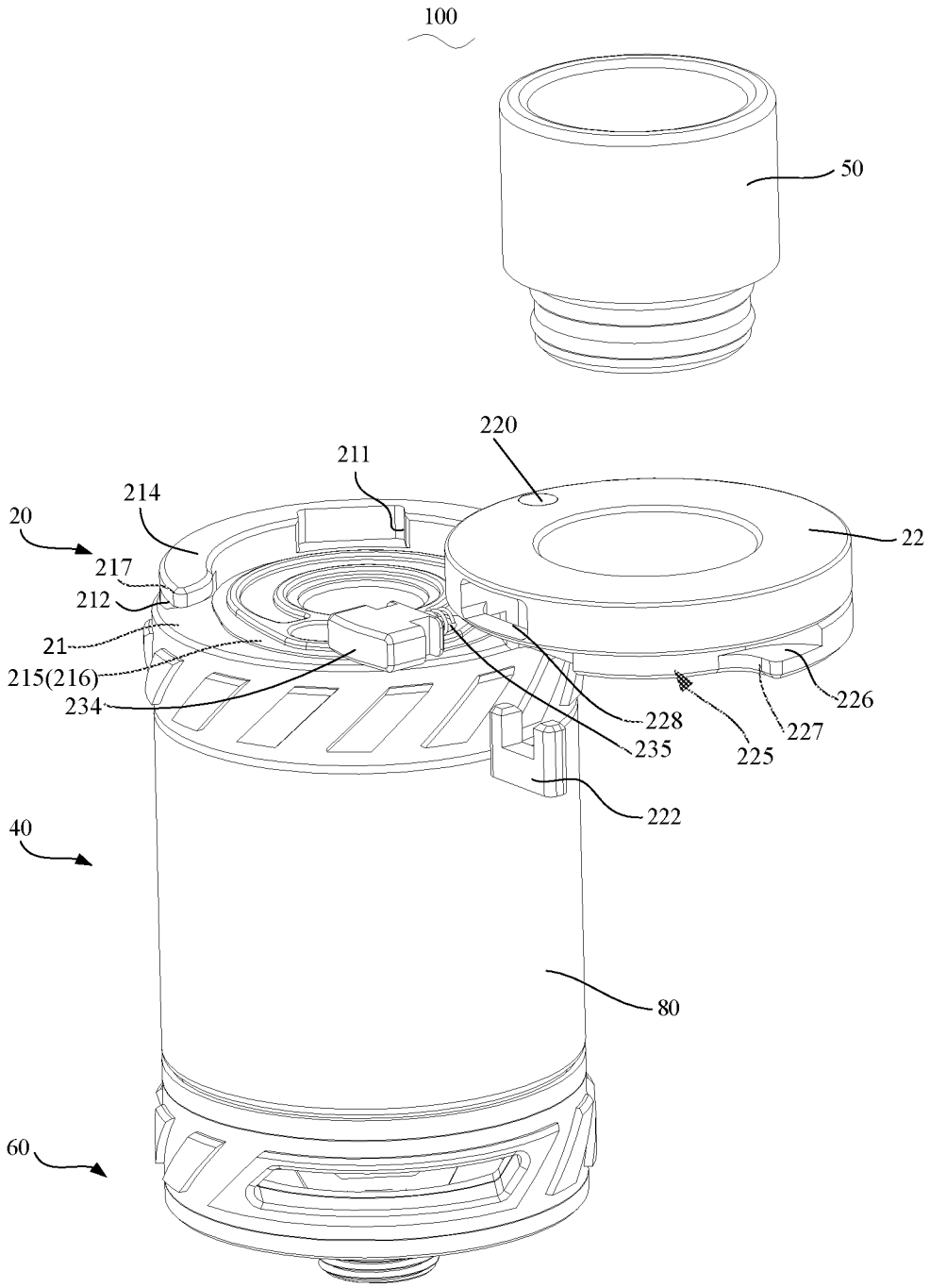
FIG. 1 is an isometric view of an atomizer being opened in accordance with an embodiment.

A clear and complete description as below is provided for the technical scheme in the embodiments of the present disclosure in conjunction with the drawings in the embodiments of the present disclosure. Obviously, the embodiments described hereinafter are simply part embodiments of the present disclosure, but all the embodiments. All other embodiments obtained by the ordinary skill in the art based on the embodiments in the present disclosure without creative work are intended to be included in the scope of protection of the present disclosure.

It should be noted that all directional indications (such as top, bottom, left, right, front, behind . . . ) in the embodiments of the present disclosure are merely to illustrate a relative position relation, a relative motion condition, etc. between each part in a certain state (for example, the state shown in the drawings). If the state changes, the directional indication changes accordingly.

In addition, if terms "first", "second", etc. appear in the present disclosure, they are merely for the purpose of description, but cannot be understood as the indication or implication of relative importance or as the implicit indication of the number of the designated technical features; therefore, features defined by "first" and "second" may specifically or implicitly include one or more such features. In the description of the present disclosure, unless otherwise stated, "a plurality of" means at least two, for example, two, three, etc.

In the present disclosure, unless otherwise specifically stated and defined, terms "connected", "fixed", etc. should be interpreted expansively. For example, "fixed" may be fixed connection, also may be detachable connection, or integration; may be mechanical connection, also may be electrical connection; may be direct connection, also may be indirect connection through an intermediate, and may be internal communication between two elements or interaction of two elements, unless otherwise specifically defined. The ordinary skill in this field can understand the specific implication of the above terms in the present disclosure according to specific conditions.

In addition, technical schemes of each embodiment of the present disclosure maybe combined mutually; however, this must be carried out on the base that the or ordinary skill in this field can implement the combination. When the combination of technical schemes has a conflict or cannot be implemented, it should considered that such combination of technical schemes does not exist and is not in the scope of protection claimed by the present disclosure.

The present disclosure relates to a battery compartment for an electronic cigarette, aiming to solve the problem of tobacco oil leaking in structure in related art.

Figure 2:
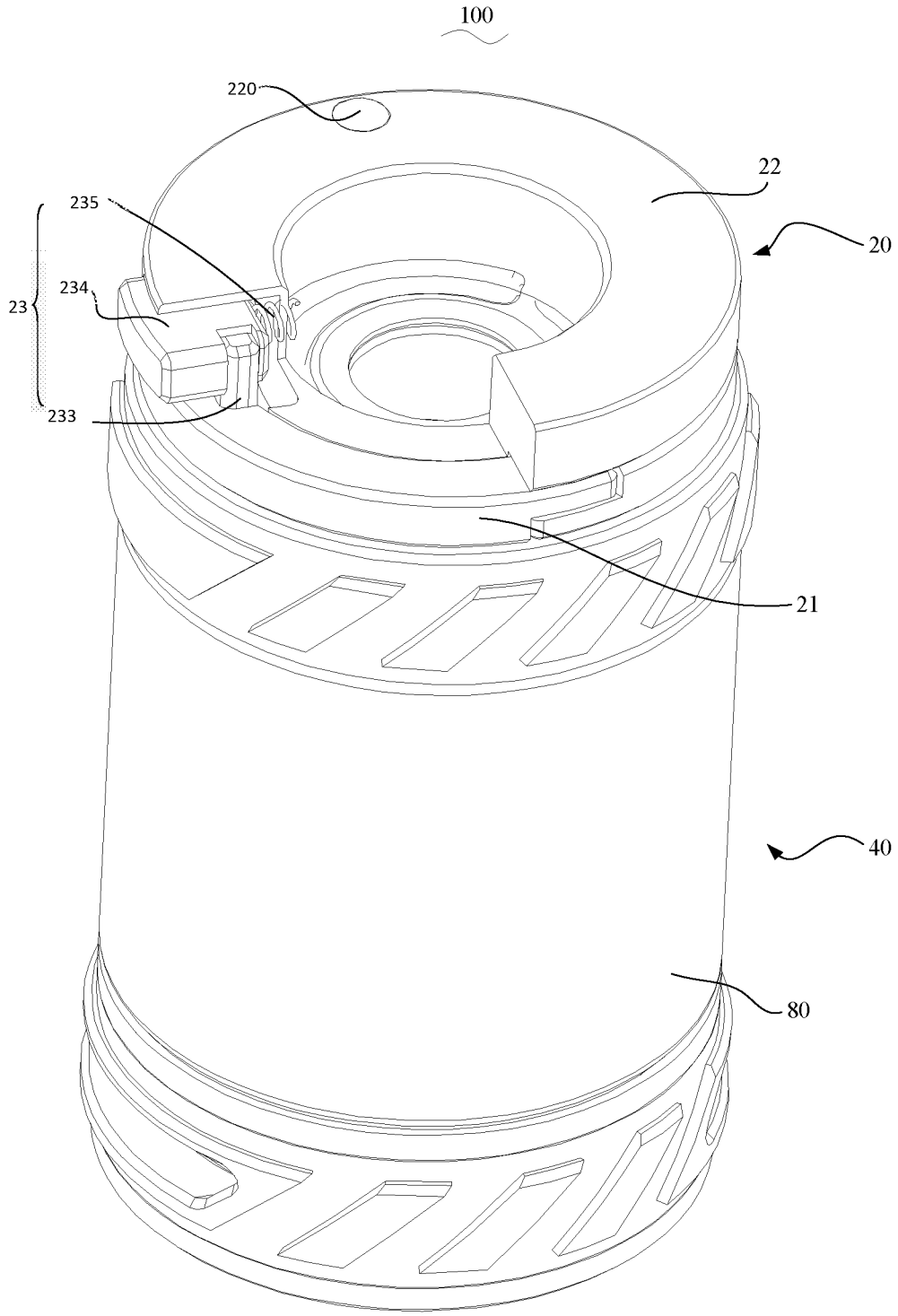
FIG. 2 is a cross-sectional view of the atomizer shown in FIG. 1 being closed in accordance with an embodiment.
Figure 3:
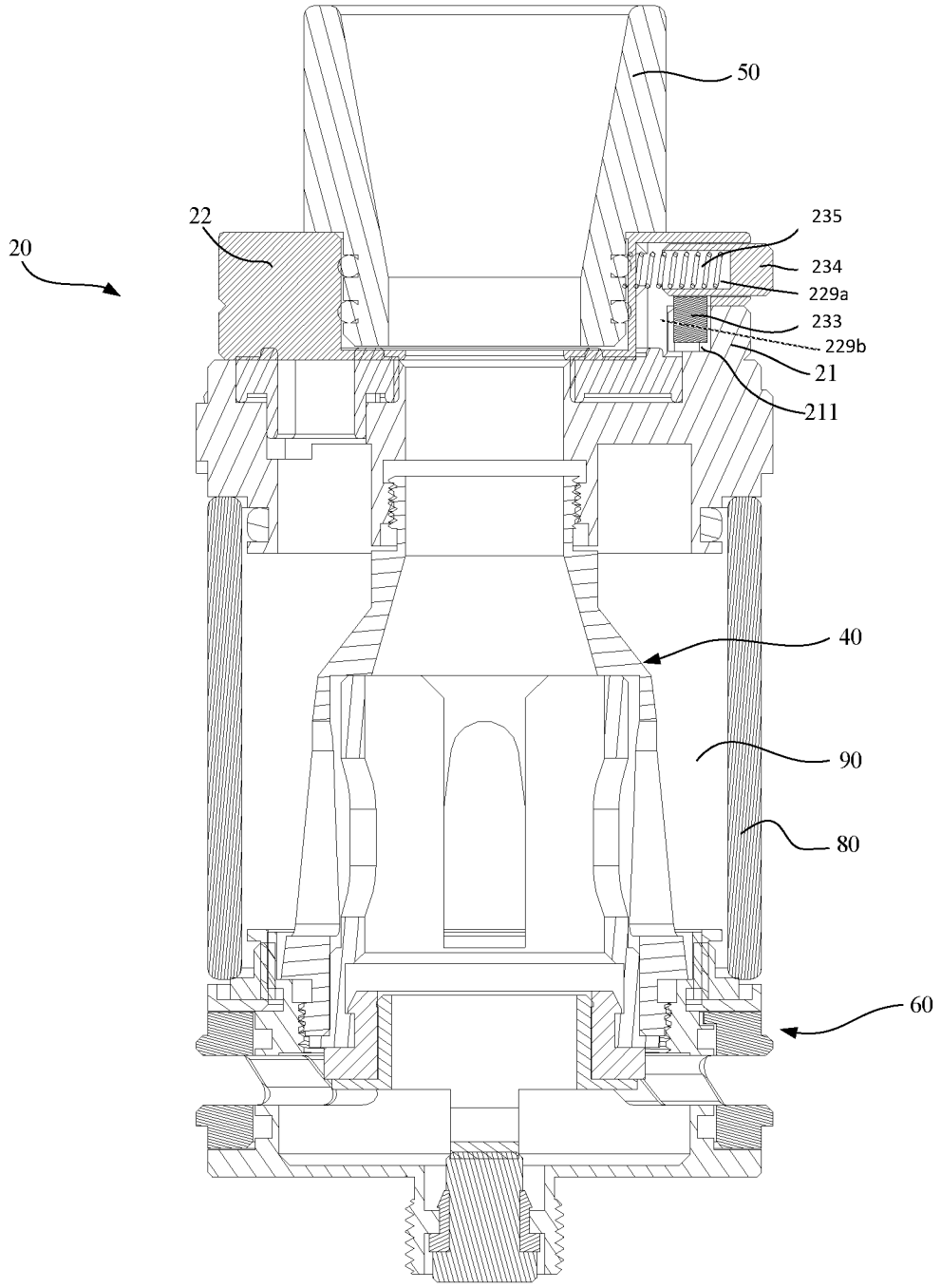
FIG. 3 is a cross-sectional view of a portion of the atomizer shown in FIG. 2 in accordance with an embodiment.
Figure 4:
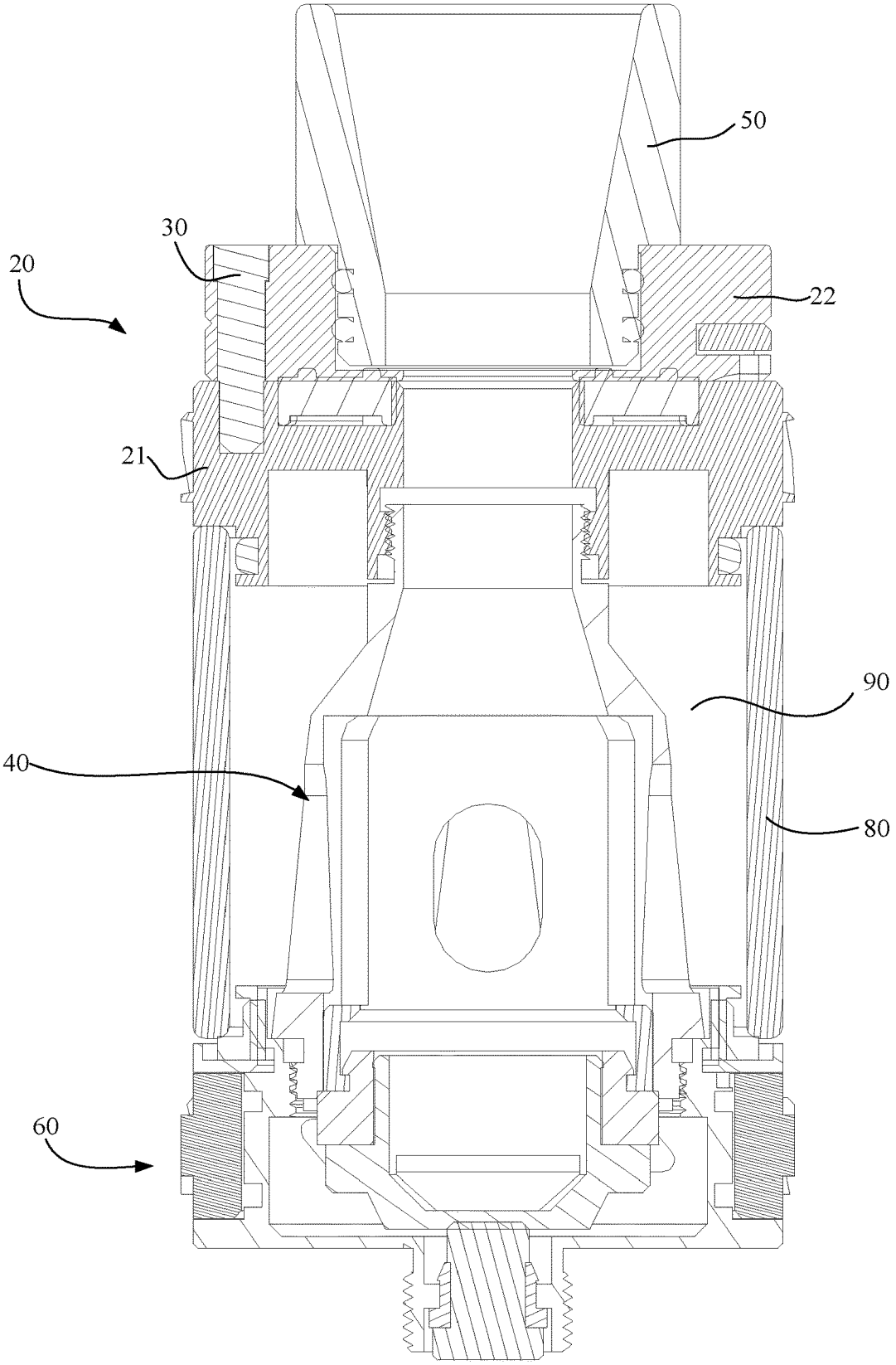
FIG. 4 is a cross-sectional view of the atomizer shown in FIG. 2 viewed from another side in accordance with an embodiment.
Figure 5:
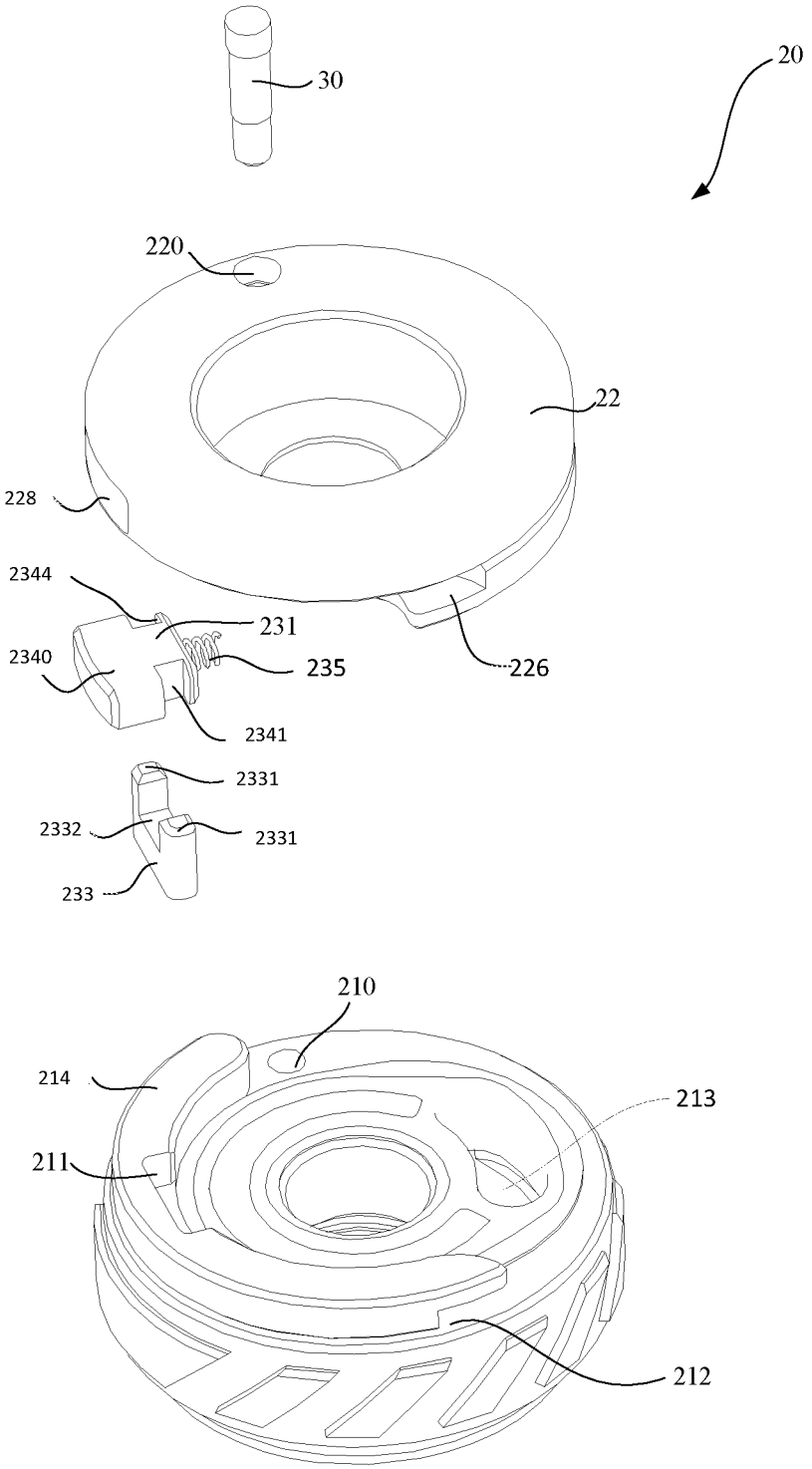
FIG. 5 is an isometric exploded view of the cover assembly in accordance with an embodiment.
Figure 6:
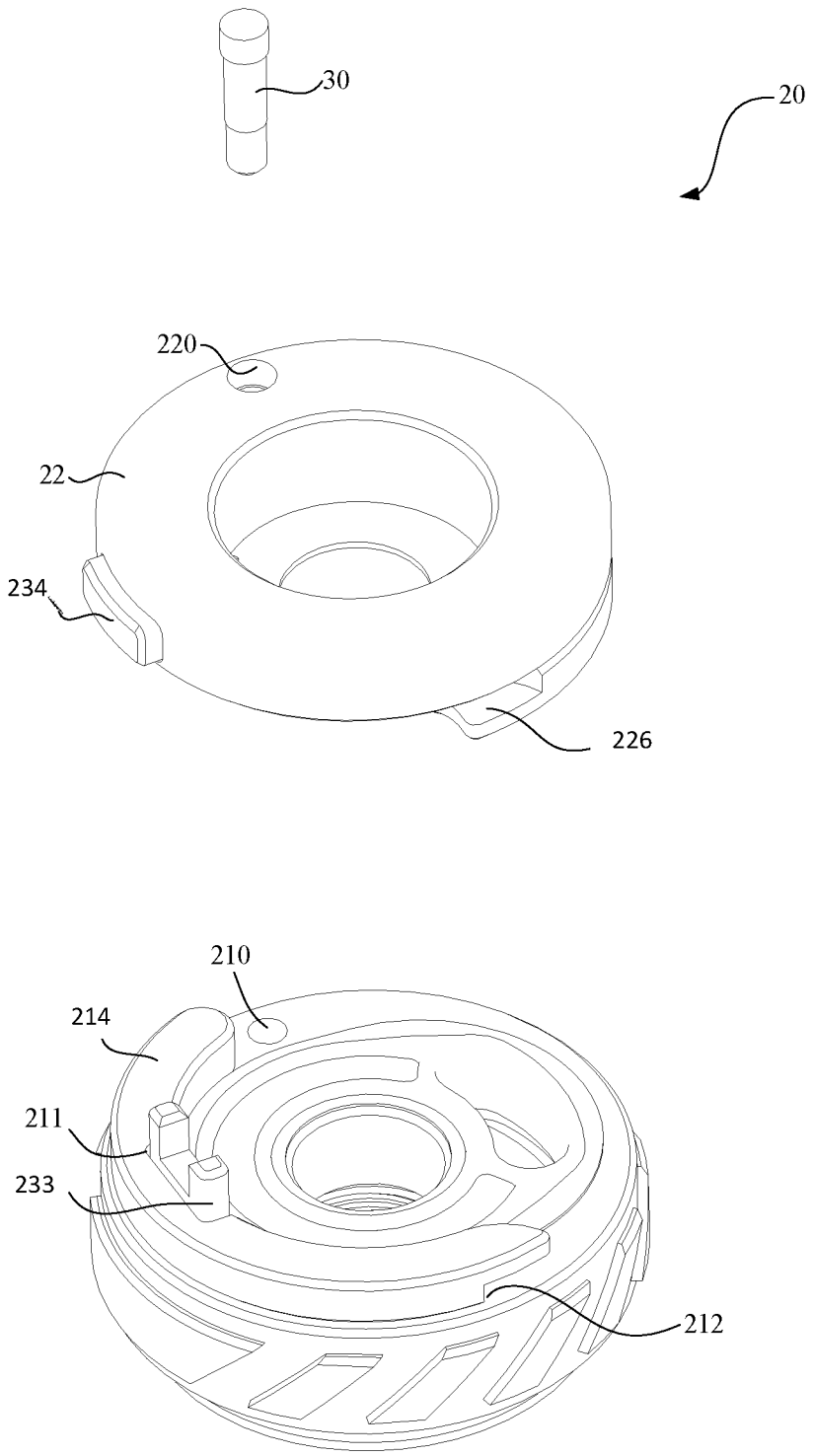
FIG. 6 is an isometric exploded view of the cover assembly shown in FIG. 1 in accordance with an embodiment.
Figure 7:
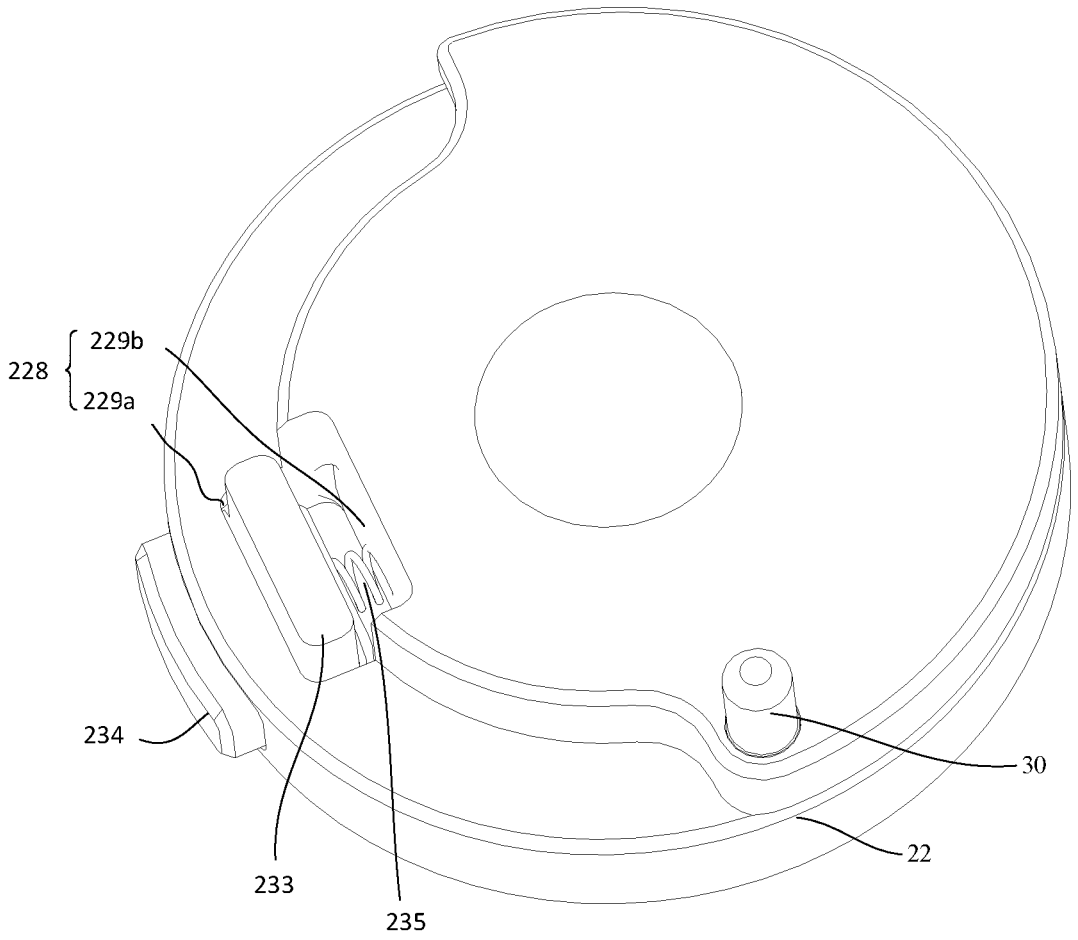
FIG. 7 is an isometric rear view of the cover shown in FIG. 1 in accordance with an embodiment.

Referring to FIGS. 1-3, in one exemplary embodiment, an atomizer 100 is capable of receiving tobacco liquid and heat the tobacco liquid into aerosol. The atomizer 100 includes a cover assembly 20, a heating assembly 40, a base assembly 60, and a pipe 80. In this embodiment, the cover assembly 20 and the base assembly 60 are coupled to two opposite ends of the heating assembly 40. The pipe 80 surrounds the heating assembly 40, and with two opposite ends being sealed by the cover assembly 20 and the base assembly 60. And the cover assembly 20, the heating assembly 40, the base assembly 60, and the pipe 80 are cooperated to form the liquid reserving chamber 90. The liquid reserving chamber 90 is configured to receive the tobacco liquid and allows the tobacco liquid to infiltrate into the heating assembly 40. The heating assembly 40 is configured to heat the tobacco oil to generate an inhalable aerosol. In this embodiment, the pipe 80 is made of transparent material which can be selected from a ground of consisting of glass and plastic. So that it is easy for users to realize that the atomizer 100 need or needn't be refilled with the tobacco oil.

The cover module 20 includes a base 21, a cover 22, and a locking assembly 23. The cover 22 is covered on the base 21. When a force is exerted to the cover 22, the cover 22 is moved and enables the base 21 to be uncovered. The cover 22 is locked on the base 21 by the locking member 22 to avoid moving with respect to the base 21 by accident.

Referring FIGS. 1, 2, 5 and 6, the base 21 is substuially in a columnar shape. The base 21 defines a first mounting hole 210, a filling hole 213, a concave 216, and a locking notch 211. The filling hole 213 communicates with the liquid reserving chamber 90 and is configured to fill tobacco liquid into the liquid reserving chamber 90. The concave 216 is formed on an upper surface of the base 21, and positioned at the middle of the base 21. A gasket 215 is covered over the concave 21 and a thickness of the gasket 215 is a bit larger than a height of the concave 216. A blocking bar 214 protrudes from an edge of an upper surface of the base 21, and is in an arc shape. The filling hole 213 is position at the concave 21 and adjacent to the edge of the base 21. The filling hole 213 is also position between two opposite ends of the blocking bar 214. One end of the blocking bar 214 is concaved to form a first groove 212 and a first protrusion portion 217. The first groove 212 is between the first protrusion portion 217 and the upper surface of the base 21. The first mounting hole 210 is adjacent to the other end of the blocking bar 214. The locking notch 211 is positioned at the middle of the bar 214, concaved from the inner surface of the blocking bar 214, and communicates with the concave 216.

Referring FIGS. 3-7, the cover 22 is substuially in a dish shape and is rotatably mounted to the base 21. The cover 22 defines a second mounting hole 220 according to the first mounting hole 210, a receiving space 225 according to the blocking bar 214, a second groove 226 according to the first protrusion portion 212, a fixing hole 228 according to the locking notch 211. A shaft 30 allows the cover 22 to rotatably mount to the base 21. One end of the shaft 30 is inserted into the first mounting hole 210 and fixed in the base 21, the other end of the shaft 30 is inserted into the second mounting hole 220 and fixed in the cover 22. The receiving space 225 is formed on a lower surface of the cover 22 and adjacent to an edge of the cover 22. The second groove 226 is concaved from an end surface of the cover 22 at the end of the receiving space 225 that a second protrusion portion 227 is formed and in accordance with the first groove 212. The fixing hole 228 is in an L shape, the fixing hole 228 includes a first fixing hole **229*a* defined on a surface of the sidewall of the cover 22, and a second fixing hole 229*b* defined on a lower surface of the cover 22 where the receiving space 225 is positioned. The first fixing hole 229*a* communicates with the second fixing hole 229*b*. It is understood that, the first fixing hole 229*a* and the second fixing hole 229*b* extend in two perpendicular directions. When the cover 22 is rotated to cover on the base 21, the blocking bar 215 is received in the receiving space 225 to stop the cover 22 rotating, the second groove 226 accommodates the first protrusion 216, and the second protrusion 227 is received in the first groove 212. It is easy to understood that the end of the bar 214 away from the shaft 30 is engaged with the cover 22. The gasket 215 is compressed tightly into the upper surface of the base 21 by the lower surface of the cover 22, the filling hole 213 is sealed by the cover 22. Further the cover 22 is not so easy opened because of a friction force between the cover 22 and the gasket 215**.

The locking assembly 23 includes a locking member 233, a pressing member 234, and an elastic member 235. The pressing member 234 is pressed to drive the locking member 22333 to move and the elastic member 235 to deform. In detail, the locking member 233 is coupled to the pressing member 234. The pressing member 234 extends out of the cover 22 via the first fixing hole **229*a*, and the locking member 233 extends out of the cover 22 via the second fixing hole 229*b*. The pressing member 234 and the locking member 233 respectively extend out of the cover 22 in two perpendicular directions. The pressing member 234 includes a pressing portion 2340, a connecting portion 2341 extending from the pressing portion 2340. The pressing portion 2340 extend out of the cover 22 via the first fixing hole 229*a*, and can move in and out of the fixing hole 228. The connecting portion 2341 defines a hollow space 2342. One end of the connecting portion 2341 is connected to the pressing portion 2340. The other end of the connecting portion 2341 extends two opposite blocking board 2344. The blocking member 233 protrudes two blocking arms 2331 in the same direction, the blocking arms 2331 face to each other. A securing groove 2332 is formed between the two blocking arms 2331. The securing groove 2332 accommodates the connecting portion 2341, the two blocking arms 2331 are clamped to the connecting portion 2340. The two blocking arms 2331 are thus positioned between the pressing portion 2340 and the blocking board 2344. An end of the elastic member 235 is limited in the hollow space 2342, the other end of the elastic member 235 abuts against the cover 22. The elastic member 235 is made of elastic material which can be selected from a group consisting of a spring, and an elastic piece. Further, in some embodiment, the two ends of the elastic member 235 are respectively connected to the blocking member 233 and the cover 22**.

When the cover 22 is covered on the base 21, the locking member 233 is locked in the locking notch 211. When the pressing member 234 is pressed to move toward the cover 22, the locking member 233 is also moved with the pressing member 234, and can depart from the locking notch 211. The elastic member 235 deforms and generates an elastic force. If the pressing member 234 is released, the elastic member 234 rebounds because the elastic force, and the locking member 233 moves back to the locking notch 211 and is locked in the locking notch 211 again. It is understood that when the cover 22 is rotated to cover on the base 21, the locking member 233 is locked in the locking notch 211, that the cover 22 is tightly fastened to the base 21. And only when the pressing member 234 is pressed to move toward the cover 22 to enable the locking member 233 to depart from the locking notch 211, will the cover 22 be released from the base 21 to rotate by an external force exerted to the cover 22.

Further, in some embodiment, the cover 22 is slidably mounted to the base 21. The cover 22 is slide on the base 21 to cover on the base 21 to seal the filling hole 213. And the cover 22 is slide on the base 21 to uncover the base 21 to unseal the filling hole 213.

Further, in some embodiment, the notch 211 is defined in the cover 22, and the locking assembly 23 is mounted to the base 21.

The atomizer 100 also defines an air passageway 99. The air flowing channel 99 runs through the cover assembly 20, the heating assembly 40, the base assembly 60. An inlet hole 61 is formed in the base assembly 60. The outlet hole 24 is formed in the cover assembly 20. The inlet hole 61 and the outlet hole 24 are communicated with the air flowing channel 99. The atomizer 100 also includes a nozzle 50, the nozzle 50 is mounted to the cover assembly 20 and communicated with the outlet 24. When the atomizer 100 is inhaled via the nozzle 50, the air flows into the passageway 99 from inlet hole 61, and flows into the heating assembly 40 via the passageway 99. The heating assembly 40 heats the tobacco oil and generates aerosol. The aerosol flows out of the heating assembly 40 via the outlet 24 and reaches to the mouth of the smoker via the nozzle 50.

The present disclosure also provides an electronic cigarette (not shown). The electronic cigarette includes the atomizer described above and a battery assembly (not shown) providing the atomizer with power. Accordingly, the cover 22 is prevented from opening by accident and the tobacco oil avoids leaking.

The above are preferred embodiments of the present disclosure merely and are not intended to limit the patent scope of the present disclosure. Any equivalent structures made according to the description and the accompanying drawings of the present disclosure without departing from the idea of the present disclosure, or any equivalent structures applied in other relevant technical fields directly or indirectly are intended to be included in the patent protection scope of the present disclosure.

What is claimed is:

1. A cover assembly for an electronic cigarette, comprising:

a base defining a filling hole;

a cover mounted to the base and covering the base to seal the filling hole, the cover being movable with respect to the base to uncover the base when a force is exerted to the cover; and a locking assembly locking the cover in the base, the locking assembly being further configured to unlock the cover in the base and allow the cover to move when the force is exerted to the cover; wherein the base further comprises a blocking bar protruding from an edge of an upper surface of the base, the upper surface faces the cover; a lower surface of the cover defines a receiving space configured for accommodating the blacking bar the lower surface faces the upper surface.

2. The cover assembly according to claim 1, wherein a notch is defined in one of the base and the cover, the locking assembly is mounted to the other one of the base and the cover, and the locking assembly is locked in the notch.

3. An electronic cigarette, comprising:

a battery assembly; and an atomizer electrically connected to the battery, the atomizer comprising:

a cover assembly, the cover assembly comprising:

a base defining a filling hole;

a cover mounted to the base and covering the base to seal the filling hole, the cover being movable with respect to the base to uncover the base when a force is exerted to the cover; and a locking assembly being operated to lock the cover in the base, the locking assembly being further configured to unlock the cover in the base and allow the cover to move when the force is exerted to the cover; wherein the base further comprises a blocking bar protruding from an edge of an upper surface of the base the upper surface faces to the cover; a lower surface of the cover defines a receiving space to accommodate the blocking bar, the lower surface faces the upper surface.

4. The cover assembly according to claim 1, wherein the notch is defined in the blocking bar, and the locking assembly is mounted to the cover.

5. The cover assembly according to claim 1, wherein an end of the blocking bar is engaged with the cover when the cover covers the base, the cover assembly further comprises a shaft adjacent to the other end of the blocking bar, the cover is rotatably mounted in the base via the shaft.

6. The cover assembly according to claim 1, wherein the locking assembly comprising a pressing member, a locking member, and an elastic member, the pressing member extends out of the cover to be operated, the locking member is coupled to the pressing member and locked in the notch, the pressing member is configured for driving the locking member to move out of the notch and driving the elastic member to deform; when the elastic member deforms, the elastic member generates an elastic force to drive the pressing member and the locking member to move back.

7. The cover assembly according to claim 6, wherein the cover further defines a fixing hole for receiving the locking assembly, the pressing member and the locking member are located in the fixing hole and respectively extend out of the cover in two perpendicular directions via the fixing hole, one end of the elastic member is fixed in the pressing member or the locking member, and the other end of the elastic member abuts against the cover.

8. The cover assembly according to claim 1, wherein the base further defines a concave, the concave is positioned at the middle of the upper surface, a gasket is placed in the concave and between the cover and base, the filling hole positioned in the concave and surrounded by the gasket.

9. An atomizer, comprising:

a liquid reserving chamber; and a cover assembly, the cover assembly comprising:

a base defining a filling hole communicating with the reserving chamber;

a cover rotatably mounted to the base and covering the base to seal the filling hole, the cover being rotatable with respect to the base to uncover the base when a force is exerted to the cover; and a locking assembly configured to lock the cover in the base, the locking assembly being further configured to unlock the cover in the base and allow the cover to move when the force is exerted to the cover; wherein the base further comprises a blocking bar protruding from an edge of an upper surface of the base, the upper surface faces to the cover; a lower surface of the cover defines a receiving space to accommodate the blocking bar, the lower surface faces the upper surface.

10. The atomizer according to claim 9, further comprising:

a base assembly;

a heating assembly having two opposite ends respectively coupled to the cover assembly and the base assembly, and a pipe having two opposite ends respectively coupled to the cover assembly and the base assembly, and the pipe surrounding the heating assembly; the pipe, the cover assembly, the base assembly and the heating assembly being cooperated to form the liquid reserving chamber, the liquid reserving chamber communicating with the heating assembly.

11. The atomizer according to claim 9, wherein a notch is defined in one of the base and the cover, the locking member is mounted to the other one of the base and the cover.

12. The electronic cigarette according to claim 3, wherein the notch is defined in the blocking bar, the locking member is mounted to the cover.

13. The atomizer according to claim 9, wherein the atomizer further comprises a shaft fixed in the base and adjacent to an end of the blocking bar, the cover is pivoted to the base via the shaft.

14. The atomizer according to claim 9, wherein the notch is defined in the blocking bar, the locking member is mounted to the cover.

15. The atomizer according to claim 11, wherein the blocking assembly comprises a pressing member, a locking member, and an elastic member, the pressing member extends out of the cover, the locking member is connected to the pressing member and locked in the notch, the pressing member is configured for driving the locking member to move away from the notch and driving the elastic member to deform, when the elastic member deforms, the elastic member generates an elastic force to drive the pressing member and the locking member to move back.

16. The electronic cigarette according to claim 3, wherein the blocking assembly comprises a pressing member, a locking member, and an elastic member, the pressing member extends out of the cover, the locking member is connected to the pressing member and locked in the notch, the pressing member is configured for driving the locking member to move away from the notch and driving the elastic member to deform, when the elastic member deforms, the elastic member generates an elastic force to drive the pressing member and the locking member to move back.

17. The electronic cigarette according to claim 3, wherein atomizer further comprises:

a base assembly;

a heating assembly having two opposite ends respectively coupled to the cover assembly and the base assembly, and a pipe having two opposite ends respectively coupled to the cover assembly and the base assembly, and the pipe surrounding the heating assembly; the pipe, the cover assembly, the base assembly and the heating assembly being cooperated to form the liquid reserving chamber, the liquid reserving chamber communicating with the heating assembly.

* * * * *